US011777262B2

(12) United States Patent
Gonzalez et al.

(10) Patent No.: US 11,777,262 B2
(45) **Date of Patent: *Oct. 3, 2023**

(54) SOLDERLESS COAXIAL CABLE CONNECTOR AND INSTALLATION THEREOF

(71) Applicant: MegaPhase, LLC, Stroudsburg, PA (US)

(72) Inventors: Maddiel Gonzalez, Hopatcong, NJ (US); Stéphane Orofino, Boonton, NJ (US)

(73) Assignee: MegaPhase, LLC, Stroudsburg, PA (US)

( * ) Notice: Subject to any disclaimer, the term of this patent is extended or adjusted under 35 U.S.C. 154(b) by 150 days.

This patent is subject to a terminal disclaimer.

(21) Appl. No.: 17/151,136

(22) Filed: Jan. 16, 2021

(65) Prior Publication Data

US 2021/0143588 A1 May 13, 2021

Related U.S. Application Data

(63) Continuation of application No. 16/295,782, filed on Mar. 7, 2019, now Pat. No. 10,897,109.

(60) Provisional application No. 62/743,399, filed on Oct. 9, 2018.

(51) Int. Cl.

| | |
|---|---|
| ***H01R 13/64*** | (2006.01) |
| ***H01R 24/40*** | (2011.01) |
| ***H01R 43/042*** | (2006.01) |

(52) U.S. Cl.

CPC ..... *H01R 24/40* (2013.01); *H01R 43/042* (2013.01)

(58) Field of Classification Search

CPC ..... H01R 9/05; H01R 24/38
USPC ..... 439/378, 482, 824
See application file for complete search history.

(56) References Cited

U.S. PATENT DOCUMENTS

| | | | |
|---|---|---|---|
| 3,040,288 | A | 6/1962 | Edlen et al. |
| 3,184,706 | A | 5/1965 | Atkins |
| 3,209,287 | A | 9/1965 | Oxner et al. |
| 3,646,496 | A | 2/1972 | Williams |
| 3,764,959 | A | 10/1973 | Toma et al. |
| 4,243,290 | A | 1/1981 | Williams |
| 4,355,857 | A | 10/1982 | Hayward |
| 5,607,325 | A | 3/1997 | Toma |
| 5,647,119 | A | 7/1997 | Bourbeau et al. |
| 6,331,123 | B1 | 12/2001 | Rodrigues |
| 6,786,767 | B1 | 9/2004 | Fuks et al. |
| 7,008,263 | B2 | 3/2006 | Holland |
| 7,131,868 | B2 | 11/2006 | Montena |
| 7,568,945 | B2 | 8/2009 | Chee et al. |
| 8,137,132 | B2 | 3/2012 | Lu |
| 8,177,583 | B2 | 5/2012 | Chawgo et al. |

(Continued)

FOREIGN PATENT DOCUMENTS

| | | |
|---|---|---|
| EP | 0041419 | 12/1981 |

*Primary Examiner* — Phuong K Dinh
(74) *Attorney, Agent, or Firm* — Alston & Bird LLP; Neal J. McLaughlin

(57) ABSTRACT

A solderless plug-in coaxial connector attachment is provided. Elements are configured to engage and capture a coaxial grounding layer (or braid) as the connector is installed on the cable. The engagements between elements enhance axial and radial captivation for mechanical robustness and electrical connectivity while minimizing the overall length of the connector. An installation tool aids in the installation of the coaxial connector.

20 Claims, 13 Drawing Sheets

(56) References Cited

U.S. PATENT DOCUMENTS

| | | | | |
|---|---|---|---|---|
| 9,905,979 | B2 | 2/2018 | Davidson, Jr. | |
| 10,573,994 | B2 | 2/2020 | Duva | |
| 10,897,109 | B2 * | 1/2021 | Gonzalez | H01R 24/40 |
| 2002/0162212 | A1 | 11/2002 | Holliday et al. | |
| 2010/0170090 | A1 | 7/2010 | Rodrigues | |
| 2012/0090169 | A1 | 4/2012 | Natoli et al. | |
| 2015/0044905 | A1 | 2/2015 | Burris | |

* cited by examiner

SOLDERLESS COAXIAL CABLE CONNECTOR AND INSTALLATION THEREOF

CROSS REFERENCE TO RELATED APPLICATION

This application is a continuation of U.S. patent application Ser. No. 16/295,782, filed Mar. 7, 2019, which is related to and claims the benefit of U.S. Provisional Patent Application No. 62/743,399, filed Oct. 9, 2018, each of which are hereby incorporated by reference in their entireties.

This application for letters patent disclosure document describes inventive aspects that include various novel innovations (hereinafter "disclosure") and contains material that is subject to copyright, mask work, and/or other intellectual property protection. The respective owners of such intellectual property have no objection to the facsimile reproduction of the disclosure by anyone as it appears in published Patent Office file/records, but otherwise reserve all rights.

BACKGROUND

Many existing coaxial cable connectors require installation by an experienced technician to achieve expected or optimal connector performance in microwave frequencies. Today's applications use RF frequency transmission up to 110 GHz in industries such as Aerospace, Defense and Telecommunication. There is a demand for cable connectors in these industries and applications for coaxial cable connectors that are able to achieve a simplified, reliable and solderless connector attachment to minimize installation time while maximizing connector performance yields and miniaturization.

5G, the latest communication standard, is planned to be stablished approximately around 2025 and is based on Internet-of-Things (IoT), which envisions a world where all devices are interconnected through mobile applications, such as self-driving cars, smart homes and cities, wearable gages etc. Communication networks will have extremely complex infrastructure designed for multi-gigabits per second (Gbps) data transmission bandwidth. Communication towers, as we know them today in size and shape, will become minicells with enhanced communication efficiency using beamforming to direct transmission where required.

Another rapidly growing application where coaxial cables and connectors are essential is space satellites. The satellite industry as a subset of telecommunications is expected to play an important role in the planned 5G communication network. The satellite industry's largest business segment is services which includes radio, broadcast amongst consumer mobile services, earth observation and others. SpaceX, Airbus and several other aerospace contractors plan to launch hundreds of satellites, forming communication networks in space in installations as complex as 5G terrestrial infrastructure. These larger communication networks in space and around us require millions of connections today and will require even more in the future. It is an objective of the invention to simplify coaxial cable connector attachment without affecting connector's mechanical and electrical robustness to support high demand and critical mission applications such as the ones mentioned above in the aerospace, defense and telecommunication markets, among others.

Electrical connectors with solderless attachments have been previously proposed. A first example of such a connector attachment is U.S. Pat. No. 7,131,868. However, the compression connector proposed in this reference has the disadvantage that the clamp force permanently deforms connector attachment elements to compress grounding braid. The permanent deformation of the body and/or tubular post elements can cause micro fractures and/or surface plating damage affecting long term mechanical and electrical connector performance.

A second example is U.S. Pat. No. 5,607,325. This solderless connector design employs a pressure clamp design using two press-fit elements. However, this design has the disadvantage that it requires installation to be performed in a specialized manufacturing machine due to the high interference fit that is required between the connector body and the bushing. Consequently, the connector attachment is not suitable for field installation.

It is the objective of the invention to provide effective solution to observed disadvantages of existing solderless coaxial cable connectors.

SUMMARY

The subject of this specification relates to a coaxial cable connector that can be attached to the cable without the need for solder. In one embodiment, the connector employs a positive lock mechanism to lock the connector components together while securing the cable to the connector.

In one exemplary embodiment, a cable connector comprises an inner locking member including an inner transition area and an exterior locking ratchet, an internal clamping ring including an internal passageway configured to receive a cable end and an external transition area configured to sandwich a shielding of the coaxial cable between itself and the inner transition area of the inner locking member, and an external locking ring including a positive locking ratchet configured to mechanically engage with the exterior locking ratchet of the inner locking member, the external locking ring being configured to hold the internal clamping ring against the inner locking member, thereby sandwiching the shielding of the cable end between the internal clamping ring and the inner locking member.

In one example, the inner transition area of the inner locking member and the external transition area of the internal clamping ring are conical.

In another example, the inner transition area of the inner locking member and the external transition area of the internal clamping ring are configured such that the shielding of the cable end folds back over the internal clamping ring at an angle of greater than 90 degrees.

In still another example, the internal clamping ring further includes a surface texture configured to engage with the shielding of the cable end.

In yet another example, the surface texture is formed by knurling.

In another example, the surface texture is included on an exterior surface of the internal clamping ring that is generally concentric with and parallel to the internal passageway.

In another example, at least one of the exterior locking ratchet and the positive locking ratchet includes two or more ratchets configured to engage with the other of the exterior locking ratchet and the positive locking ratchet.

In another example, the exterior locking ratchet and the positive locking ratchet each include two or more ratchets configured to engage with the other of the exterior locking ratchet and the positive locking ratchet.

In another example, the external locking ring engages the internal clamping ring via an interference fit and also engages the inner locking member via an interference fit in addition to the engagement of the exterior locking ratchet and the positive locking ratchet.

In another example, the cable connector further comprises an adaptor component including female threads, the adaptor component being positioned about the inner locking member such that it is permitted to rotate about the inner locking member, but restrained in an axial direction between the external locking ring and a split ring engaged with a groove in the inner locking member.

In another example, the internal passageway of the inner clamping ring has a smaller diameter than an outer diameter of the cable jacket, but larger than the diameter of the cable shielding such that the inner passageway of the inner clamping ring is directly adjacent to the shielding before the shielding is folded over the inner clamping ring.

In another example, the exterior locking ratchet of the inner locking member includes at least one slit.

In another exemplary embodiment, a cable connector installation tool comprises a tool body including a cable entry and a nub port coaxially aligned with the cable entry along a cable axis, a blade positioned between the cable entry and the nub port and retractable towards and away from the cable axis, a jacket nub including a bore having a bottom, the bottom of the bore being configured at a predetermined jacket trim distance from the blade measured along the cable axis, a core nub, and a core nub cap configured to temporarily sandwich a connector component and a cable shielding folded over the connector component between the core nub cap and the core nub, wherein the jacket nub and the core nub are alternately and removably insertable into the nub port of the tool body.

In another example, the blade is retractable to a jacket cutting position a first distance away from the cable axis with the jacket nub inserted into the nub port to cut the jacket of the cable and is retractable to a dielectric cutting position a second distance away from the cable axis with the core nub inserted into the nub port to cut the dielectric of the cable, the first distance being larger than the second distance.

In another example, the cable connector installation tool further comprises a moveable handle, an interface nub configured to temporarily engage an end connector component, a solid jaw configured to receive the interface nub, and a split jaw including a channel configured to receive a cable and having a surface facing the solid jaw configured to engage an intermediate connector component positioned about an end of the cable, wherein movement of the handle towards the tool body causes the split jaw and the solid jaw to move closer to one another such that the end connector component and the intermediate connector component are forced together.

In another example, when a preconfigured level of compression of the connector components has been achieved, the compression force being exerted on the solid and split jaws is released.

In another example, the release of the compression force occurs whether or not the handle is moved away from the tool body.

In another example, when a preconfigured level of compression of the connector components has been achieved, an audible signal is emitted from the cable connector installation tool.

In another exemplary embodiment, a cable connector installation tool kit comprises a cable connector installation tool, at least two different jacket nubs, at least two different core nubs, and at least two different interface nubs.

DETAILED DESCRIPTION

Embodiments of solderless coaxial cable connectors and methods for their installation are described herein. While aspects of the described cable connectors and methods of installation can be implemented in any number of different configurations, the embodiments are described in the context of the following exemplary configurations. The descriptions and details of well-known components and structures are omitted for simplicity of the description.

The description and figures merely illustrate exemplary embodiments of the inventive cable connectors and methods of installation. It will thus be appreciated that those skilled in the art will be able to devise various arrangements that, although not explicitly described or shown herein, embody the principles of the present subject matter. Furthermore, all examples recited herein are intended to be for illustrative purposes only to aid the reader in understanding the principles of the present subject matter and the concepts contributed by the inventors to furthering the art, and are to be construed as being without limitation to such specifically recited examples and conditions. Moreover, all statements herein reciting principles, aspects, and embodiments of the present subject matter, as well as specific examples thereof, are intended to encompass equivalents thereof.

The present disclosure provides a coaxial connector attachment that eases the manufacture and installation process, in part by eliminating solder joints while maintaining the same or better mechanical and electrical connection with a coaxial cable and its shielding. Various embodiments described herein provide an overview of the present inventions' key features. However, the designs' features are not limited to the examples and figures provided herein for illustration purposes. For instance, the examples presented and discussed herein are described in the context of a single connector interface type, however the present inventions are not so limited and may be adapted to apply to any coaxial or other cable interface.

Figure 1:
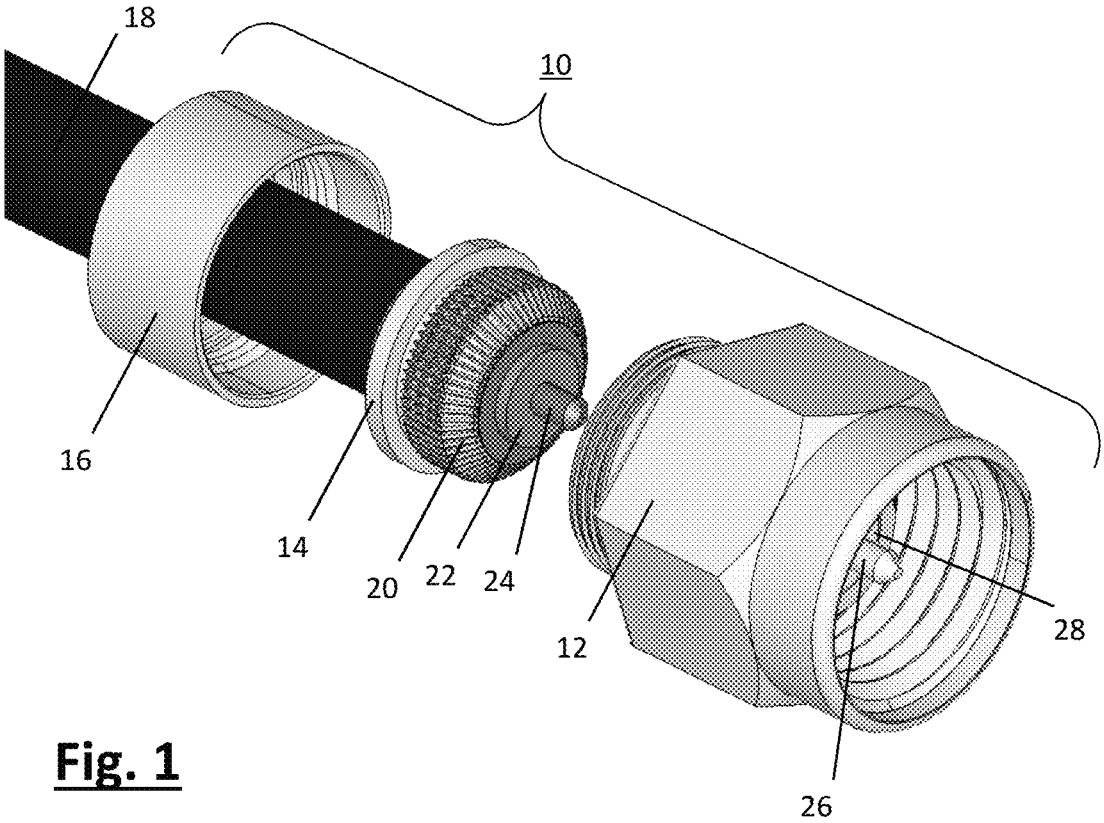
FIG. 1 shows a perspective view of a connector and cable prior to completion of installation.

The disclosure provides, in an exemplary embodiment, shown generally in FIG. 1, a plug-in electrical coaxial connector 10 comprising a connector head 12, an internal clamping ring 14, and an external locking ring 16. The connector is adapted to connect to the end of a coaxial cable 18 that includes a jacket 30, shielding 20, a dielectric 22 and an inner conductor 24. Connector 10 also includes a transition conductor 26 and transition insulator 28. The transition conductor 26 may be configured to be capable of achieving acceptable transmission of, for example, microwave frequencies.

Figure 2:
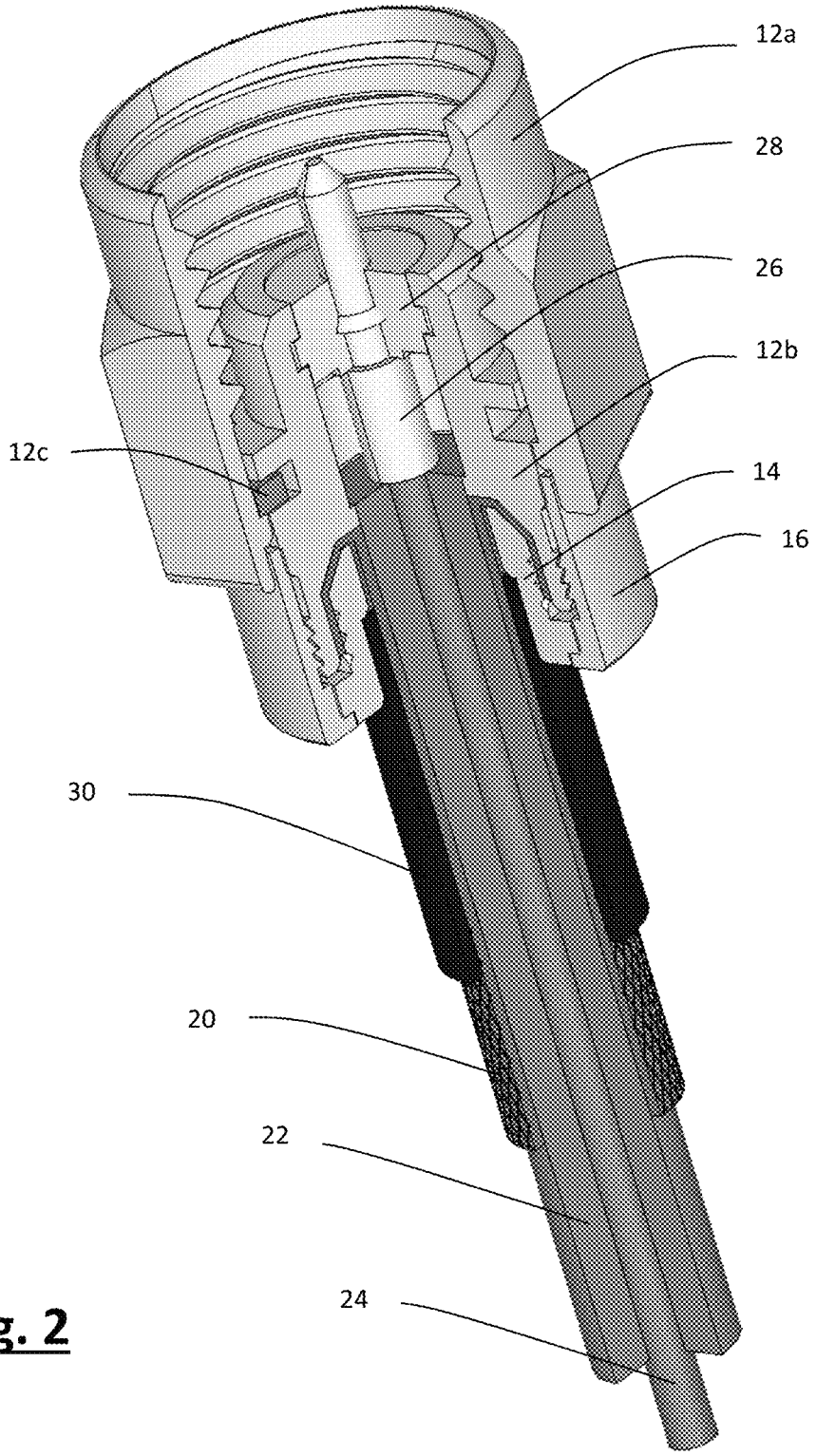
FIG. 2 shows a perspective, partial cutaway view of a connector installed on a cable.

As shown in FIG. 2, a connector head 12 may include an adaptor component 12*a*, an inner locking member 12*b* and a split ring 12*c*. In the embodiment shown, adaptor component 12*a* includes female threads which may be configured to mate with an external male connection. In this embodiment, adaptor component 12*a* is able to rotate with respect to locking member 12*b*, but the relative axial movement between those components is restrained by the split ring 12*c*. As is evident from FIG. 2, there may be some axial play allowed between adaptor component 12*a* and locking member 12*b* until the external locking ring 16 is installed, as the circular edge of the external locking ring serves to further constrain the adaptor component 12*a* in the axial direction. The adaptor component 12*a* and locking member 12*b* may be held in radial alignment by mating surfaces of each component, or by surfaces that are configured to provide radial alignment through contact with split ring 12*c*. In one example, the adaptor component 12*a* is configured to mate with standard external mating interfaces, for example those defined by MIL-STD-348 and/or IEEE 287-2007, which are hereby incorporated by reference in their entireties. In another embodiment, the connector head 12 may be formed of an integral body (made of one or more constituent, but locked together bodies) that has no moving parts. The connector head in this embodiment may be configured to mate with an external interface that is not threaded, for example.

Figure 3:
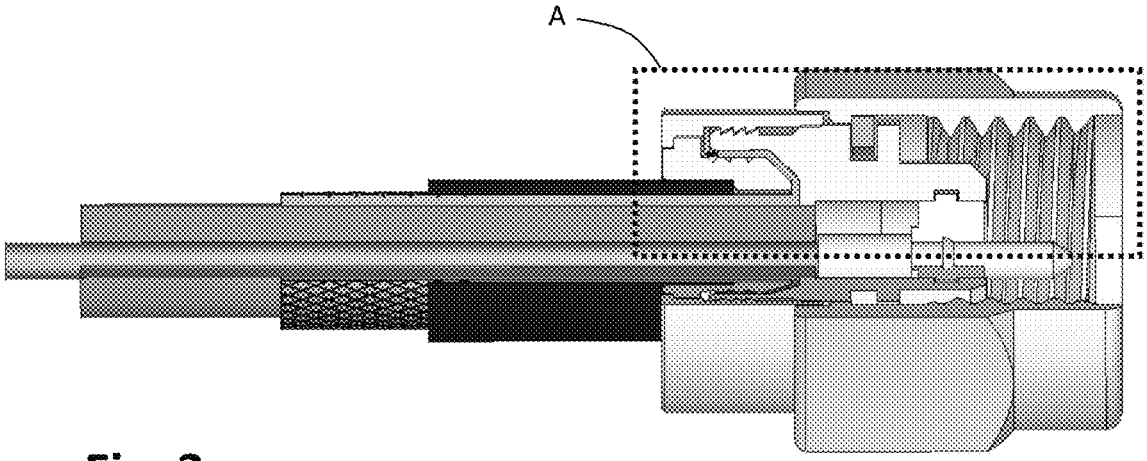
FIG. 3 shows an orthographic, partial cutaway view of a connector installed on a cable.
Figure 3A:
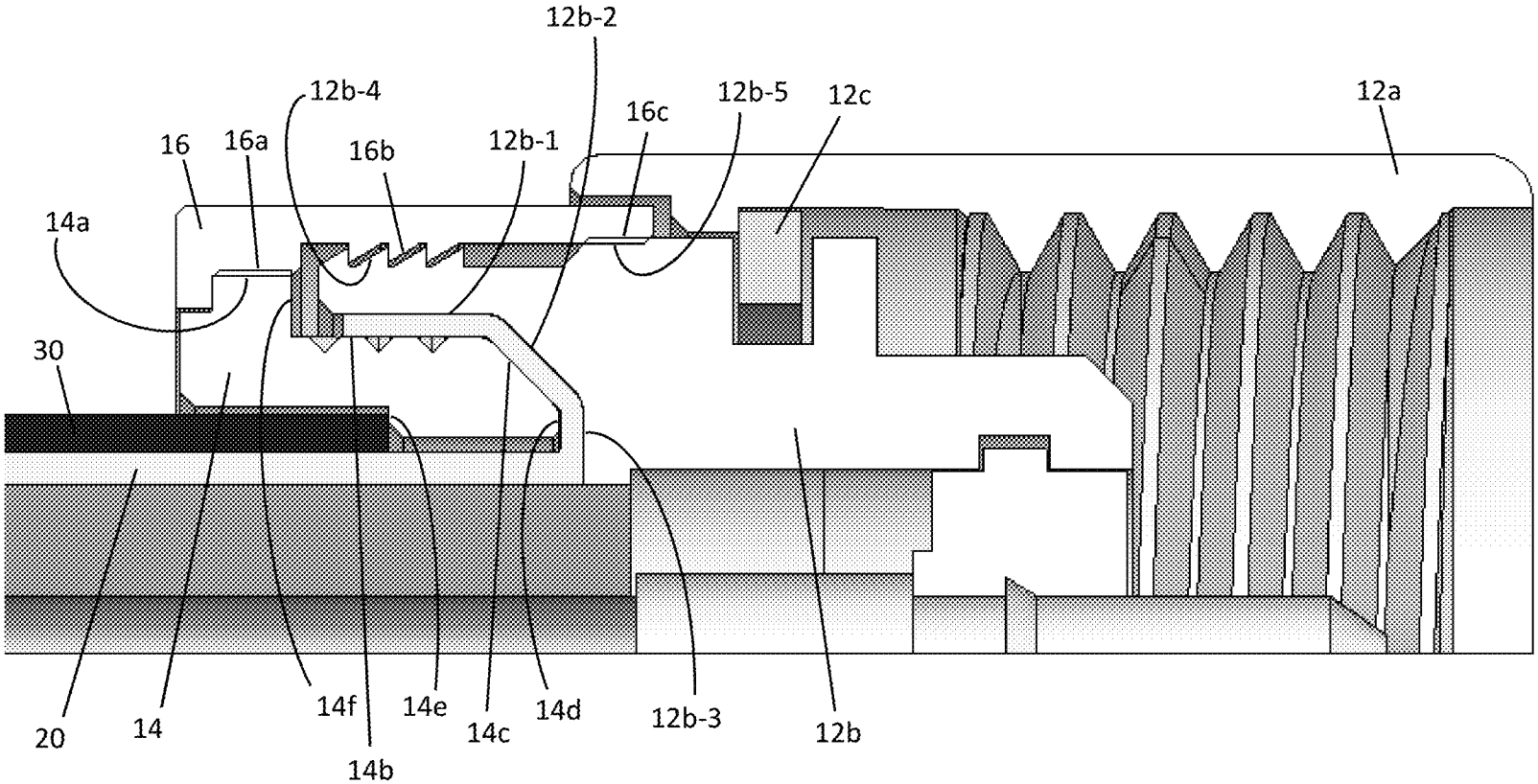
FIG. 3A shows a detailed orthographic, partial cutaway view of a connector installed on a cable corresponding to the broken lines shown in FIG. 3 denoted by the letter "A"

FIG. 3 shows an orthographic, partial cutaway view of a connector installed on a cable and FIG. 3A shows a detailed orthographic, partial cutaway view of a connector installed on a cable corresponding to the broken lines shown in FIG. 3 denoted by the letter "A." As shown in FIG. 3A, an inner locking member 12*b* may be configured with a cylindrical inner surface 12*b*-1, a tapered transition area 12*b*-2 and a shoulder 12*b*-3. The inner locking member 12*b* may be configured with an outer surface that contains a positive locking ratchet 12*b*-4 and/or an interference fit area 12*b*-5.

As is also shown in FIG. 3A, an internal clamping ring 14 may be configured to include an internal through diameter (passageway). The external surface of the internal clamping ring 14 may be configured to include an interference fit area 14*a*, a cylindrical outer surface 14*b*, a tapered transition area 14*c*, a nose 14*d*, an inner shoulder 14*e* and an outer shoulder 14*f*. The cylindrical outer surface 14*b* and/or nose may be textured, such as with grooves, sandblasting, EDM texturing, or knurling.

Figure 4:
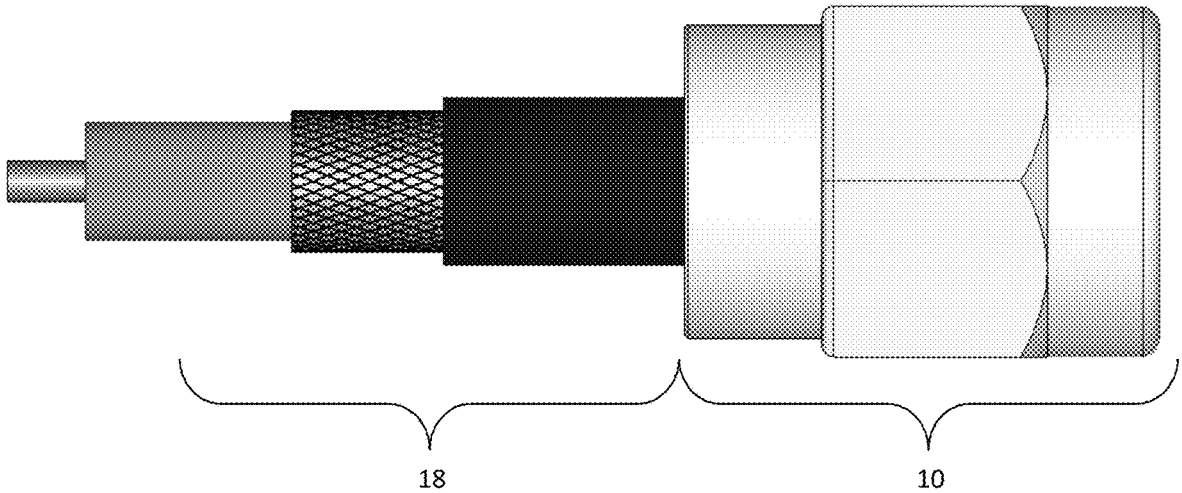
FIG. 4 shows an orthographic view of a connector installed on a cable.

As is also shown in FIG. 4A, external locking ring 16 may be configured to include an internal interference fit area 16*a*, a positive locking ratchet 16*b* and/or an interference fit area 16*c*.

Figure 5:
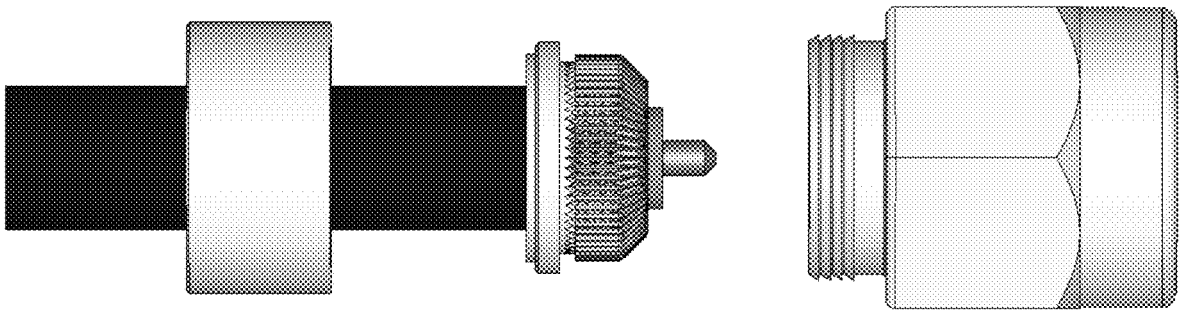
FIG. 5 shows an orthographic view of a connector and cable prior to completion of installation.
Figure 6:
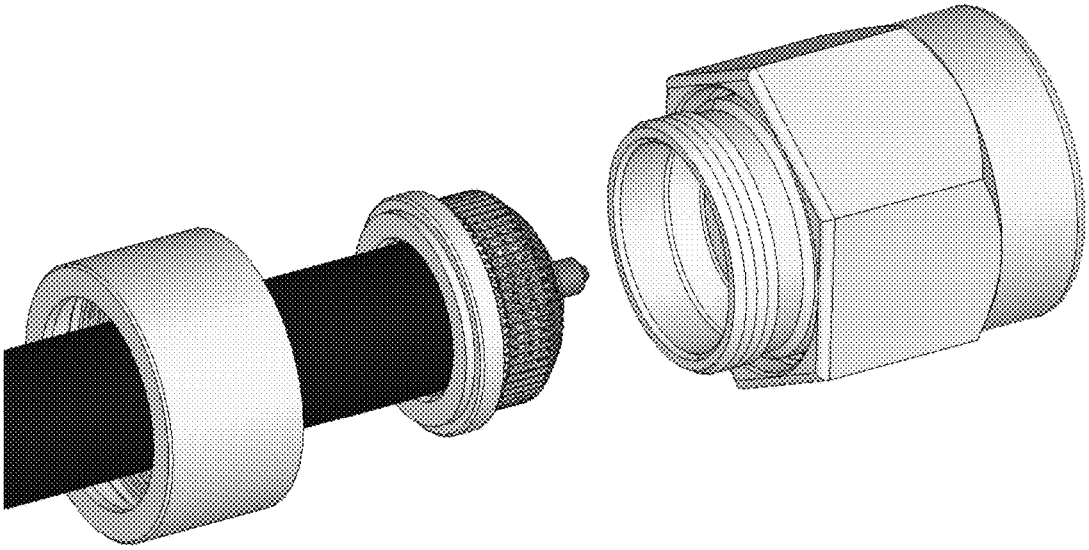
FIG. 6 shows a perspective view of a connector and cable prior to completion of installation.

During the installation process, all elements of coaxial cable may be cut generally perpendicular to the axis of the cable in a single plane. An external locking ring 16 may be slid over the cable 18. Any jacket 30 of the cable 18 may be trimmed to a predefined setback from the previous perpendicular cut. An inner clamping ring 14 may be slid over the cable 18. The inner locking ring may be positioned so that the inner shoulder 14*e* is proximate the trimmed end of the jacket 30, as shown in FIGS. 2 and 3A. The shielding 20 of the cable 18 may then be folded back over the nose 14*d*, transition area 14*c* and outer surface 14*b*. In the example shown in FIGS. 2 and 3A, the shielding 20 is folded back at approximately a 90 degree angle past the nose 14*d*, then approximately 135 degrees (more than 90 degrees) through the transition area 14*c*, then finally 180 degrees proximate the outer surface 14*b*. Of course, other angles and geometries are possible. For example, the nose 14*d* may be configured such that the shielding is folded back more than 90 degrees at the initial fold over the nose 14*d*. If the internal clamping ring 14 is provided with inner shoulder 14*e* and the inner shoulder 14*e* rests against the trimmed end of the jacket 30, the axial restriction provided by the trimmed end of the cable jacket 30 may aid in the folding back of the shielding 20. After it is folded back, any portion of the shielding 20 extending past the outer shoulder 14*f* may be trimmed. This stage of installation is approximately represented in FIGS. 1, 5 and 6.

An inner locking member 12*b* may then be brought to the folded back shielding 20 such that the cylindrical inner surface 12*b*-1, tapered transition area 12*b*-2 and shoulder 12*b*-3 sandwich the folded back shielding between the outer surface 14*b*, transition area 14*c* and nose 14*d*, respectively. The adaptor component 12*a*, split ring 12*c*, transition conductor 26 and transition insulator 28 may be assembled together with the inner locking member 12*b* before or after installation of the inner locking member 12*b* over the shielding 20. Once the inner locking member 12*b* is installed over and is sandwiching the shielding as described above, the external locking ring 16 may be slid forwards along the cable 18 towards the inner clamping ring 14 at the end of the cable.

As the external locking ring 16 is forced into the inner clamping ring 14, the inner clamping ring 14 in turn is forced into the inner locking member 12, sandwiching the shielding between the inner locking member 12 and the inner clamping ring 14. As this occurs, (i) an interference fit engagement may begin to be established between the interference fit area 16*a* of the external locking ring 16 and the interference fit area 14*a* of the inner clamping ring 14, (ii) the positive locking ratchet 16*b* of the external locking ring 16 and the a positive locking ratchet 12*b*-4 of the inner locking member 12*b* may begin to engage each other, and (iii) an interference fit engagement may begin to be established between the interference fit area 16*c* of the external locking ring 16 and the interference fit area 12*b*-5 of the inner locking member 12*b*. The order of these engagements (i), (ii) and (iii) is configurable (for example by varying the axial spacing between any of areas 16*a*, 16*b*, 16*c*, 14*a*, 12*b*-4 and/or 12*b*-5) and may be designed to occur in a particular order depending on the desired characteristics of the overall engagement and/or the sandwiching of the shielding 20. For example, engagement (i) may be configured to begin before engagement (ii) and engagement (ii) may be configured to begin before engagement (iii).

The mating positive locking ratchets 16*b* and 12*b*-4 may each be configured with a discrete number of ratchets, or slopes. For example, in the example shown in FIG. 3A, there are three discrete points of engagement between the three positive locking ratchets 16*b* and the four positive locking ratchets 12*b*-4. As discussed above, the connector components may be configured such that the first pair of mating positive locking ratchets 16*b* and 12*b*-4 engage one another before any of the various interference fit areas begin to engage. As the mating positive locking ratchets 16*b* and 12*b*-4 engage one another, each discrete engagement of mating ratchets or slopes may typically be heard (i.e., by a "click" sound) or felt by a person assembling the components as the mating slopes slide along one another (during which time the components are temporarily and reversibly deformed to allow their passage) and are released when they fully pass one another. In one example, the positive locking ratchets 12*b*-4 of the inner locking member 12*b* may be slit one or more times to provide flexibility to the positive locking ratchets 12*b*-4 as they are temporarily and reversibly deformed by the positive locking ratchets 16*b* of the external locking ring 16 during installation to relieve internal stresses and decrease the compressive force necessary to complete installation.

The shape, number and/or location of the mating positive locking ratchets 16*b* and 12*b*-4 relative to each other and relative to other features of the components may be configured so as to enable the engagement of the discrete ratchets to serve as indicators for the level and completeness of engagement between the connector components. This configuration may also take into account the thickness, malleability and stiffness of the shielding as well as the geometry of the components. For example, the connector components may be configured such that when the installer hears and/or feels three ratchet engagements, that is an indication that the components are fully engaged and the cable connector installation is complete.

Figure 8:
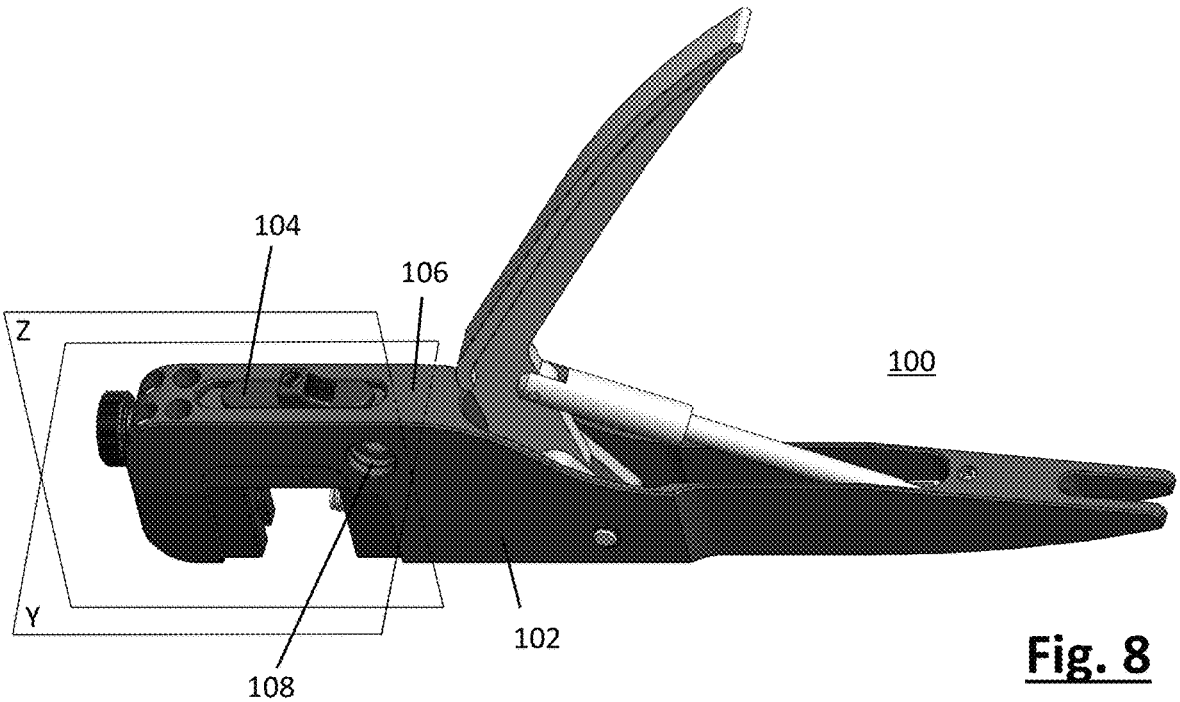
FIG. 8 shows another perspective view of an exemplary installation tool.
Figure 9:
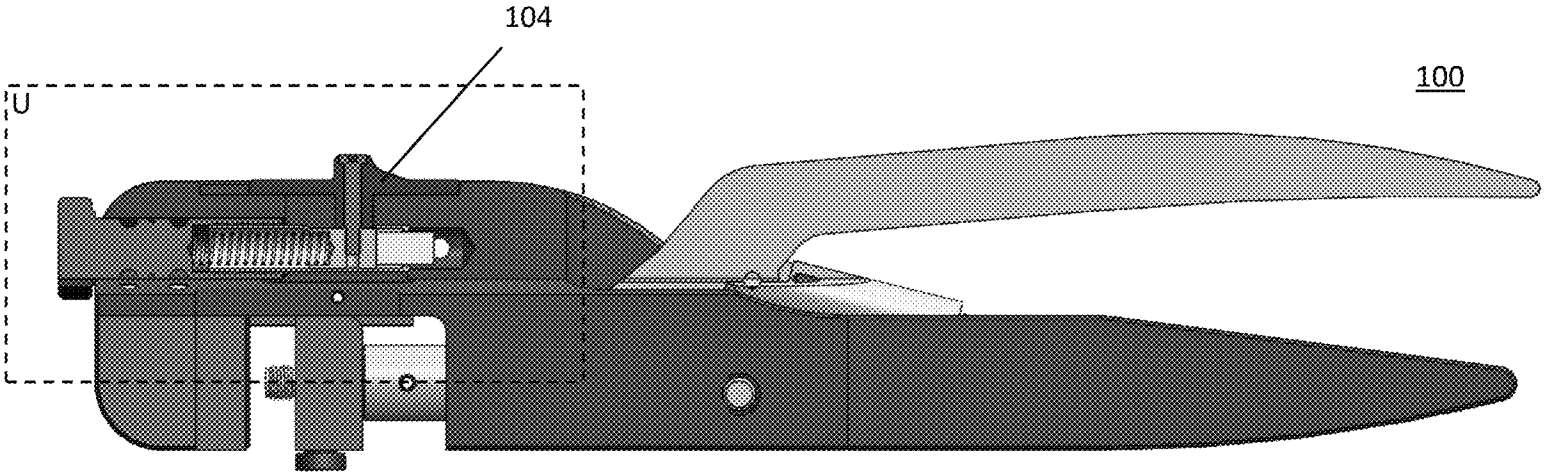
FIG. 9 shows a partial cross section view of the installation tool 100 of FIG. 8 taken along cross section plane Z shown in FIG. 8.
Figure 9A:
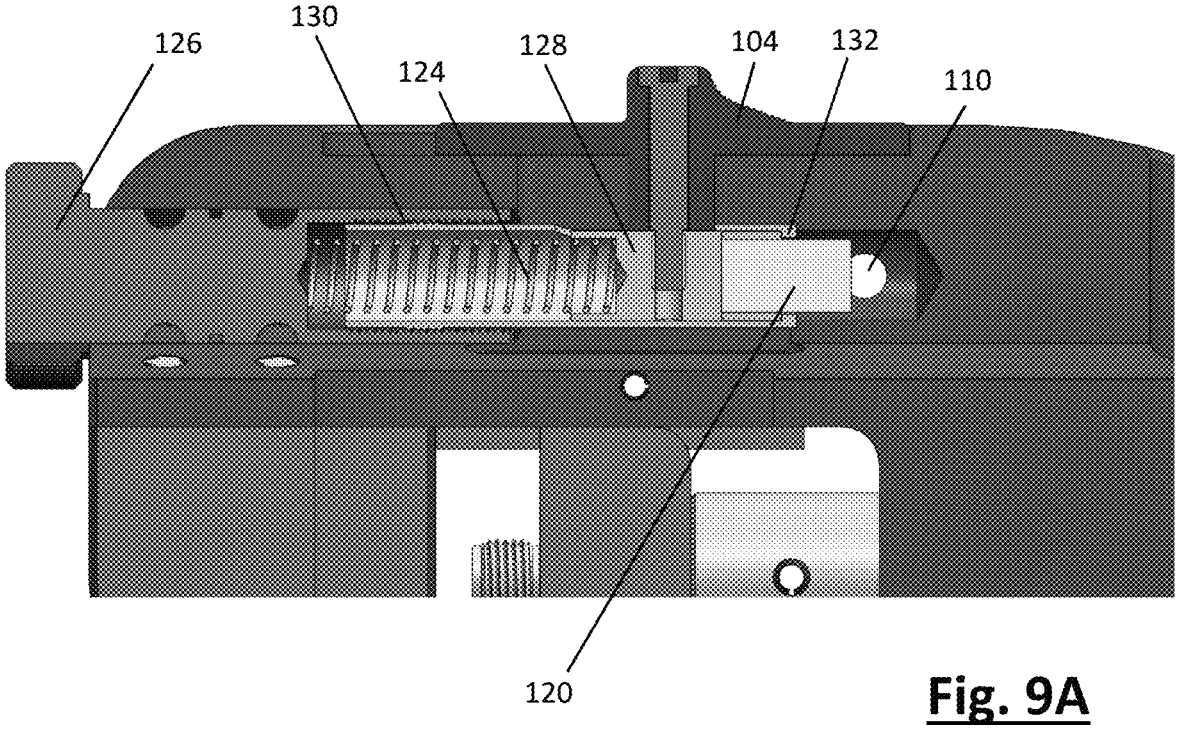
FIGS. 9A and 9B are zoomed-in views of window U shown in FIG. 9, with components of the installation tool in various configurations.
Figure 9B:
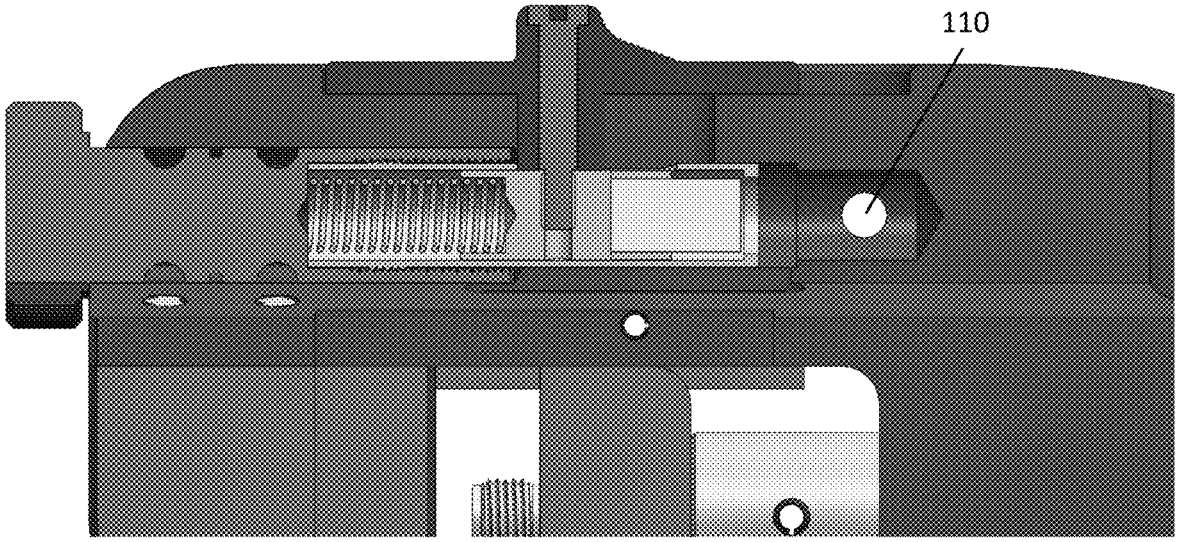
Figure 9C:
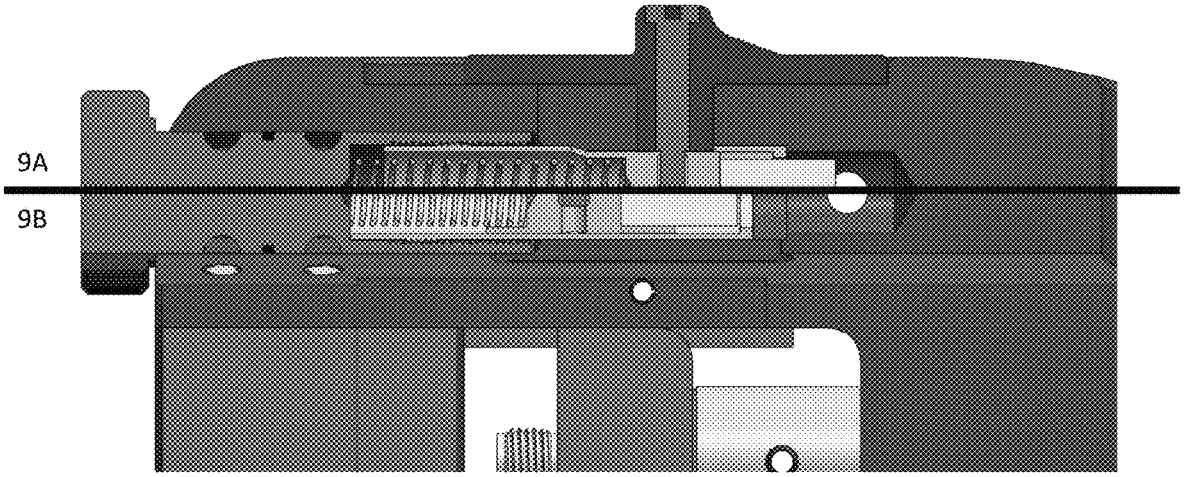
FIG. 9C compares the configurations shown in FIGS. 9A and 9B.
Figure 10A:
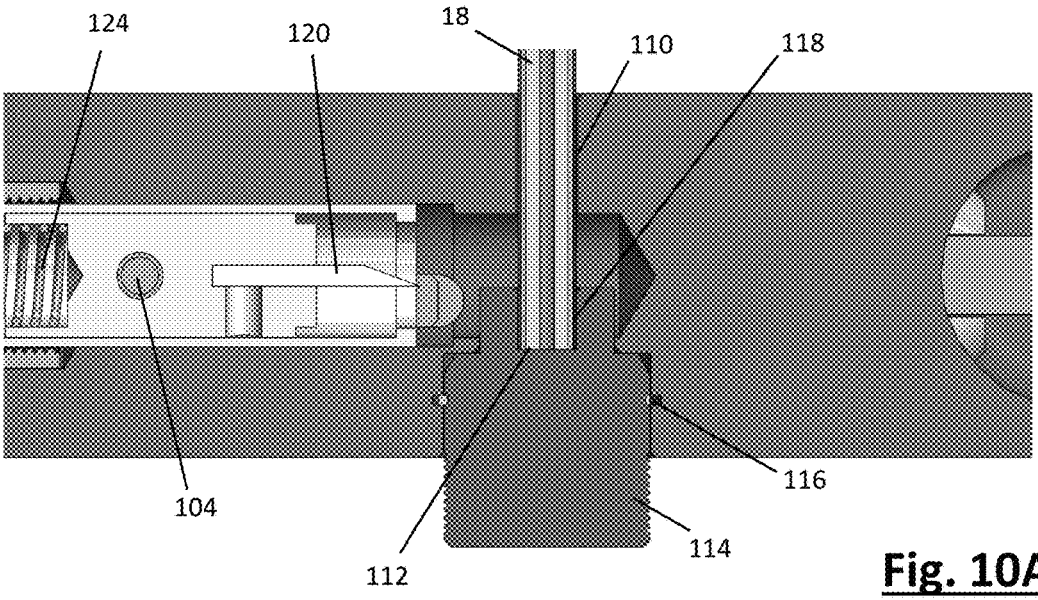
FIGS. 10A, 10B and 10C are partial cross sectional views of an installation tool taken along cross section plane Y shown in FIG. 8, with components of the installation tool in various configurations.
Figure 10B:
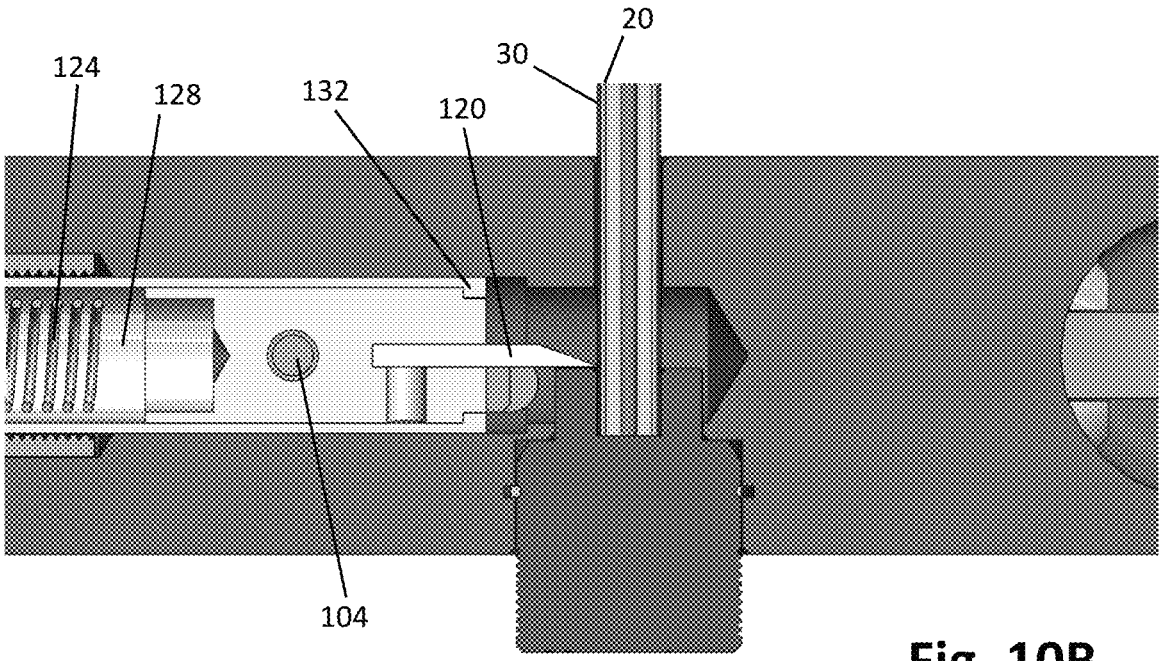
Figure 10C:
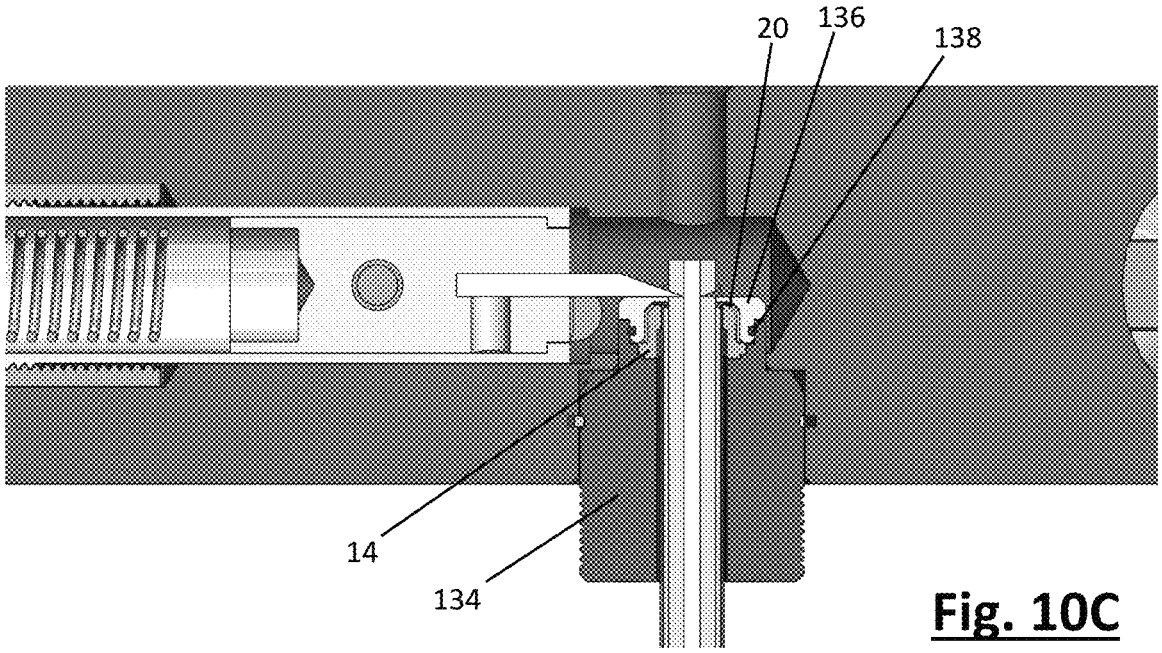

In one embodiment, an installation tool may be used to aid with the preparation and installation of the connector on a coaxial cable. An example of an installation tool 100 according to one embodiment is shown generally in FIGS. 7 and 8. FIG. 9 shows a partial cross section view of the installation tool 100 of FIG. 8 taken along cross section plane Z shown in FIG. 8, which, for purposes of orienting the reader, is generally parallel to face 102 of the installation tool 100 and bisects trigger 104. FIGS. 9A and 9B are zoomed-in views of window U shown in FIG. 9, with components of the installation tool in various configurations as will be described below. FIG. 9C compares the configurations shown in FIGS. 9A and 9B. FIGS. 10A, 10B and 10C are partial cross sectional views of an installation tool taken along cross section plane Y (shown in FIG. 8, which, for purposes of orienting the reader, is generally parallel to face 106 of the installation tool 100 and contains the axis of nub port 108 and cable entry 110), with components of the installation tool in various configurations as will be described below.

Figure 11:
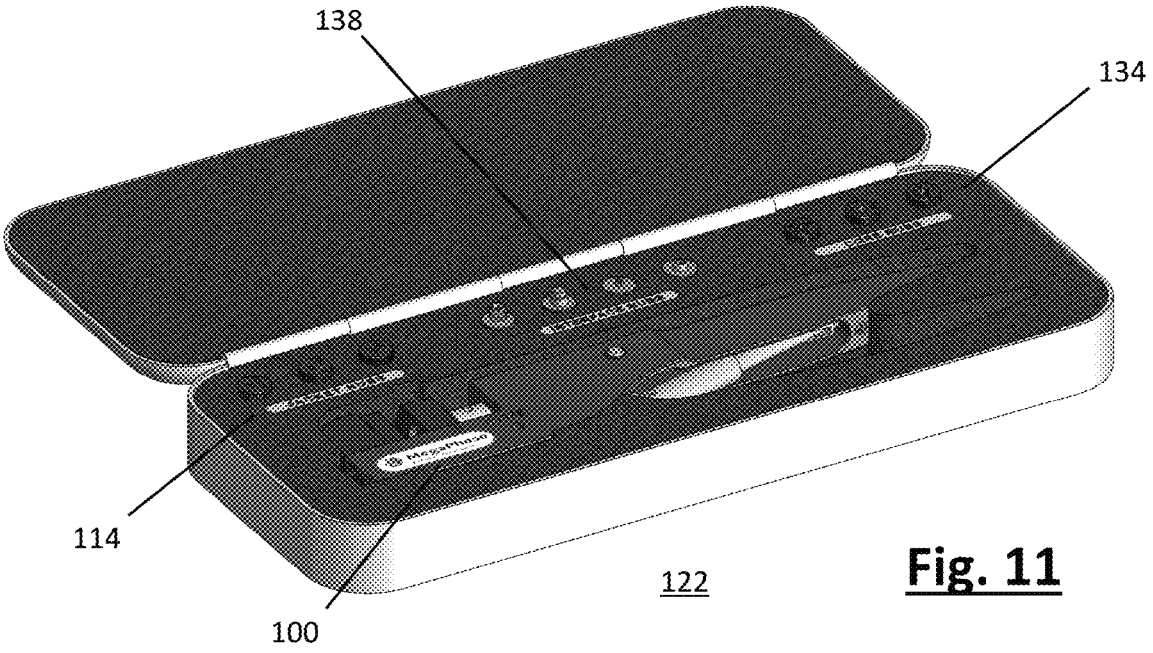
FIG. 11 is a perspective view of an exemplary interface tool kit.

As mentioned above, after a cable is cut perpendicularly to the axis of the cable in a single plane, one of the first installation steps for the connector described herein is to strip an appropriate length of the cable jacket 30. As shown in FIG. 10A, a cable 18 may be inserted into the cable entry 110 of the installation tool 100 up to a registration surface 112 in an appropriately selected jacket nub 114. Jacket nubs 114 may be inserted into the nub port 108 of the installation tool. Optionally, a split ring, elastomeric o-ring or other detention device 116 may be employed between the installation tool 100 and jacket nub 114 to keep the jacket nub 114 securedly and removably inserted into the installation tool 100. Jacket nubs 114 may be configured with receiving bore having a registration surface 112 and diameter 118 configured to match the geometries of the cable connector components 10 and cable 18, respectively. For example, the distance between registration surface 112 and the cutting edge of the blade 120 measured along the cable axis may be configured based on the desired distance between inner shoulder 14*e* of the inner clamping ring 14 and the end of the inner conductor 24 inside the transition conductor 26. As shown in FIG. 11, an installation tool kit 122 may include several different jacket nubs 114 for different cables and/or connectors.

As shown in FIG. 9A, the blade 120 may be movable towards and away from the cable port 110. A spring 124 may bias the blade 120 towards the cable entry 110 and its spring rate and spring force may be selected according to the force needed to cut through the jacket 30 and dielectric 22. The maximum protrusion of the blade 120 towards the axis of the cable entry 110 may be limited by an adjustable depth stop. For example, a depth stop may comprise a captive knob 126 and a sliding stop 128. As shown in FIGS. 9A and 9B, the captive knob 126 may be axially captive relative to the body of the installation tool 100 but may be permitted to rotate. Captive knob 126 may be configured with threads 130 that engage mating threads of the sliding stop 128. Sliding stop 128 may be prohibited from rotating axially with respect to the body of the installation tool 100. The sliding stop 128 may include a lip or other feature 132 to stop the protrusion of the blade 120. The shaft of the captive knob 126 may be marked with gradations to permit measured adjustment of the blade's maximum protrusion. The installation tool 100 may further comprise a trigger 104 coupled to the blade 120 that allows a user to manually compress the spring 130 and retract the blade from the axis of the cable entry 110. Using the trigger 104, a user may retract the blade 120, then insert a cable 18 through the cable entry 110 until the end of the cable rests against registration surface 112 of the jacket nub 114. FIGS. 9B and 10A show the spring 124, blade 120 and trigger 104 in a retracted configuration, while FIGS. 9A, 10A and 10C show these components in an unretracted configuration and at the maximum protrusion allowed by the setting of the captive knob 126 and sliding stop 128. FIGS. 9A and 9B are compared in FIG. 9C. As shown in FIG. 10B, the maximum blade 120 depth set by the captive knob 126 and sliding stop 128 may be configured at this stage of the installation to allow the blade to cut the jacket 30, but not the shielding 20. After the trigger 104 is released with the cable 18 fully inserted into the jacket nub 114, the user then twists the cable 18 approximately one revolution while the blade 120 cuts through the jacket 30. The cut portion of the end of the cable's jacket 30 may then be removed from the cable 18 and discarded. The jacket nub 114 may then be removed from the installation tool 100.

With the jacket 30 trimmed, the cable 18 may be inserted through an external locking ring 16 and then a core nub 134, as shown in FIG. 10C. An internal clamping ring 14 may then be inserted onto the cable 18 and the shielding 20 may be bent back over the internal clamping ring 14 as described above. A core nub cap 136 may be placed over the folded back shielding 20 and securely and removably held onto the core nub 134 by, for example, an elastomeric o-ring 138.

Accordingly, as shown in FIG. 10C, the internal clamping ring 14 and folded back shielding 20 may be sandwiched between the core nub 134 and the core nub cap 136. An electrically important dimension in the finished cable connector described herein is the distance measured along the axis of the cable 18 between an end of the dielectric 22 and the furthest point of the shielding 20 as it folds over the internal clamping ring 14 at nose 14*d*, shown in FIG. 3A. This distance, as well as others, may be configured precisely by the installation tool 100 through configuration of the geometries of the core nub 134 and the core nub cap 136, as shown in FIG. 10C.

The blade's "core" or dielectric 22 cutting depth may be set by the captive knob 126 and sliding stop 128 and may be configured at this stage of the installation to allow the blade to cut the dielectric 30, but not the inner conductor 24. Retracting the blade 120 via the trigger, the core nub 134 and cable assembly may be inserted into the nub port 108 of the installation tool 100, as shown in FIG. 10C. After the trigger 104 is released, the user then twists the cable 18 approximately one revolution while the blade 120 cuts through the dielectric 22. The cut portion of the end of the cable's dielectric 22 may then be removed from the cable 18 and discarded. The core nub 134 may then be removed from the installation tool 100 and the core nub 134 and core nub cap 136 may be removed from the cable 18. In one example, the core nub 134 may be comprised of two or more separable components configured to allow removal of the core nub 134 from the cable 18 regardless of whether the other end of the cable 18 is free or contains a connector. For example, as shown in FIG. 11, core nubs 134 may be split in half along the cable axis to allow for removal from the cable 18 and the core nub halves may be held together by the surfaces of the nub port 108 with the cable inserted therethrough, as shown in FIG. 10C.

Figure 7:
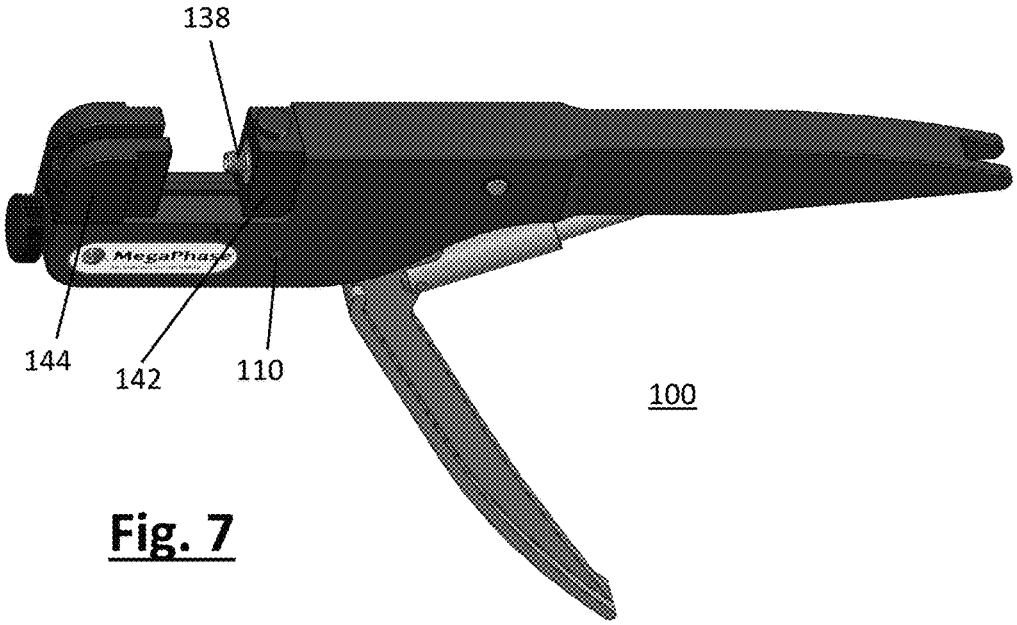
FIG. 7 shows a perspective view of an exemplary installation tool.
Figure 12:
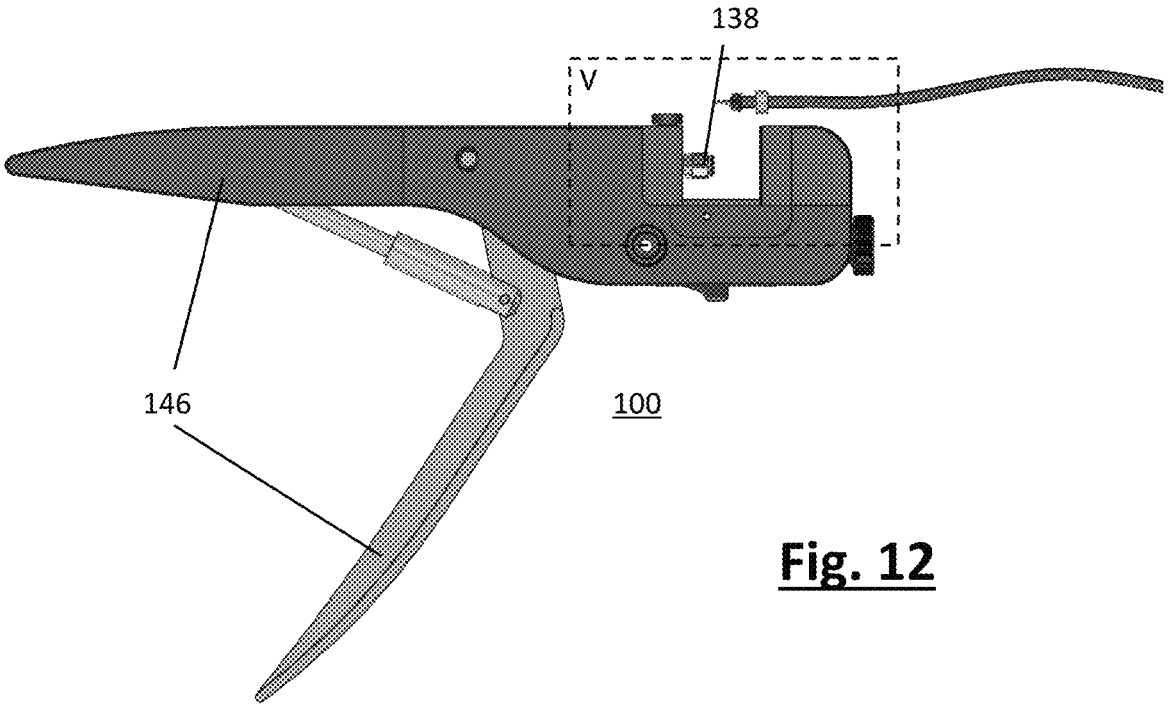
FIG. 12 shows an exemplary interface tool with an interface nub attached.
Figure 12A:
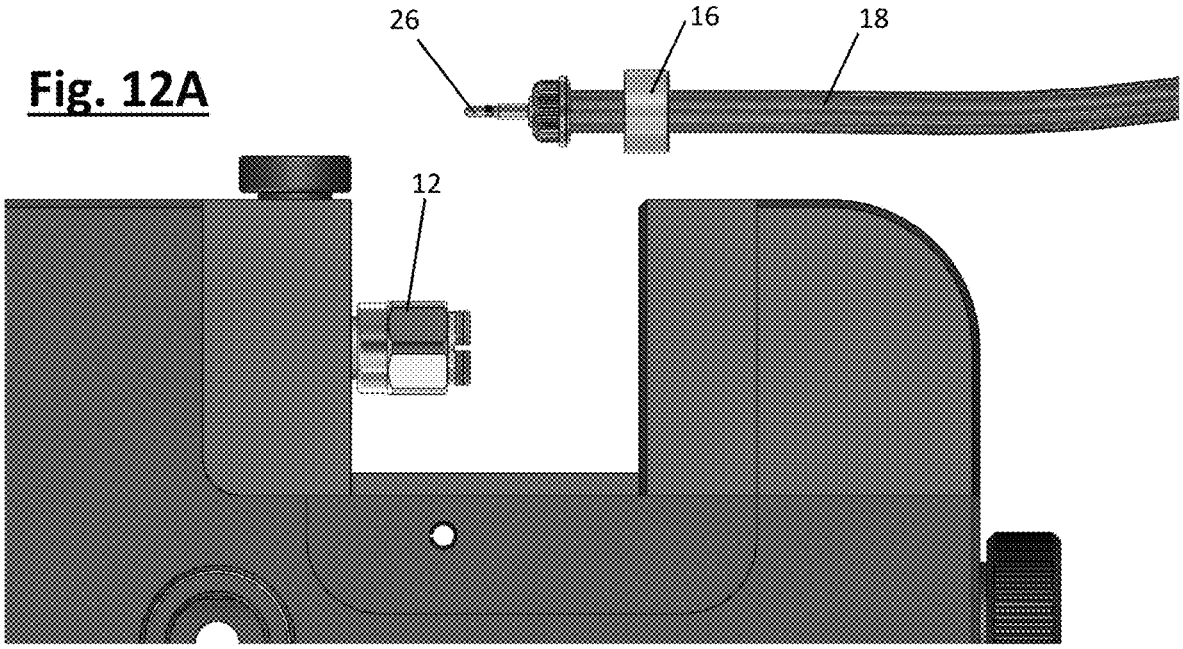
FIGS. 12A, 12B and 12C are zoomed in views corresponding to window V shown in FIG. 12, with components of the installation tool in various configurations.
Figure 12B:
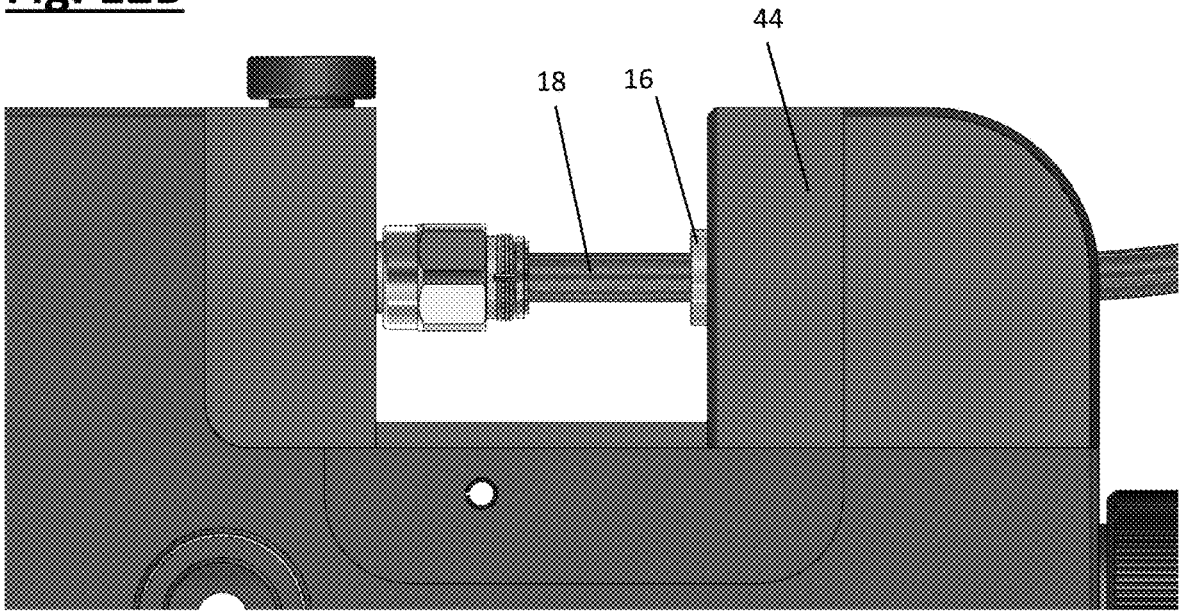
Figure 12C:
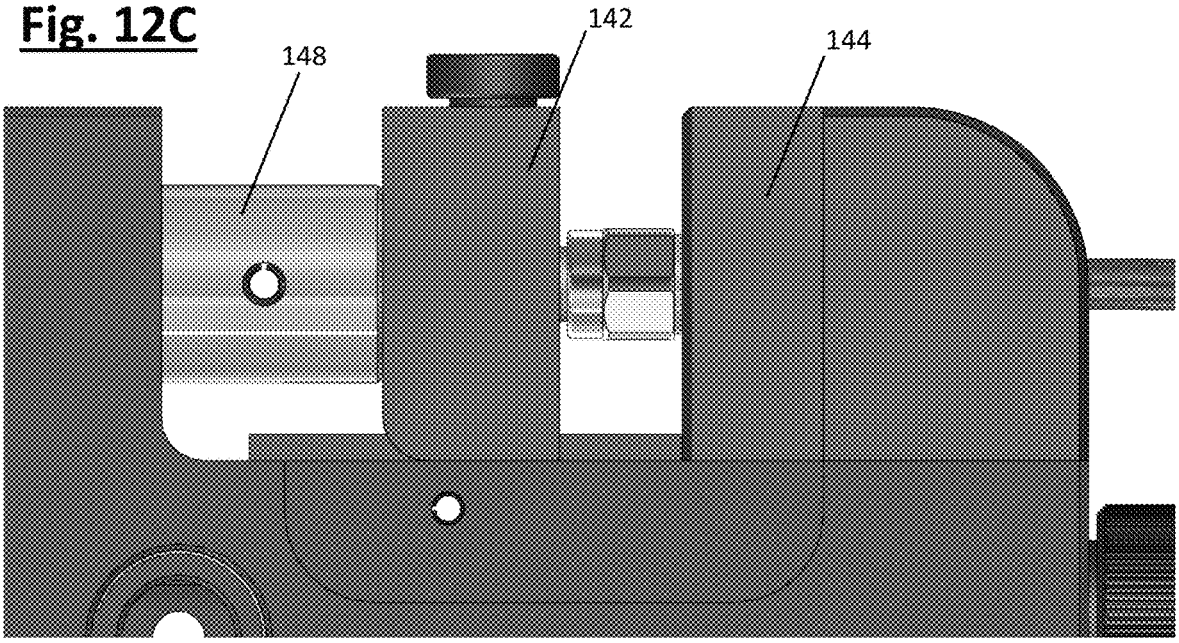
Figure 12D:
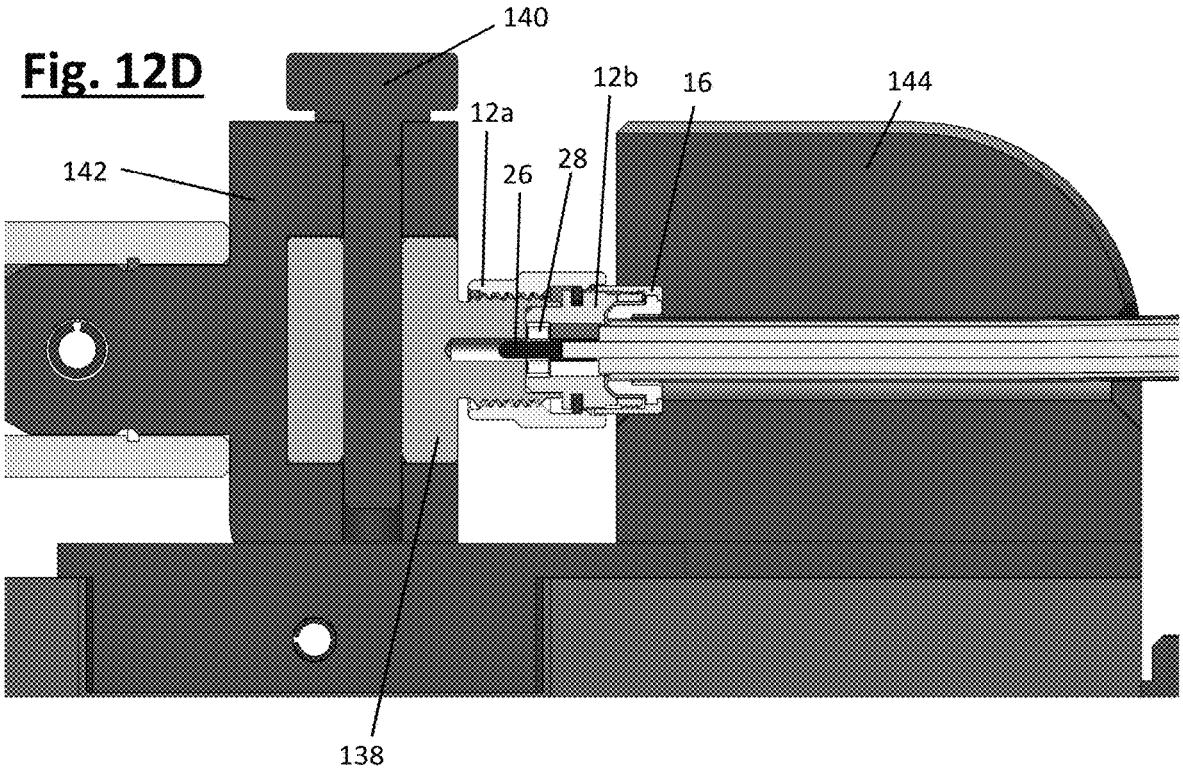
FIG. 12D is a zoomed in cross section view of the installation tool shown in FIG. 12C, taken along plane Z, which is shown in FIG. 8.

Next, an appropriate interface nub 138 is fixed to the installation tool 100, as shown in FIG. 12. FIGS. 12A, 12B and 12C are zoomed in views corresponding to window V shown in FIG. 12, with components of the installation tool in various configurations as will be described below. FIG. 12D is a zoomed in cross section view of the installation tool 100 shown in FIG. 12C, taken along plane Z, which is shown in FIG. 8 and described above. As shown in FIG. 7, the installation tool may comprise a solid jaw 142 and a split jaw 144. As shown in FIG. 12D, the interface nub 138 may be removably secured to the solid jaw 142 of the installation tool 100 with a screw 140 through a through hole of the interface nub 138, however one skilled in the art will recognize other securing methods are possible.

The installation tool 100 includes a mechanism to force the solid jaw 142 and split jaw 144 together. For example, as shown in FIG. 7, the installation tool may include handles 146 and a piston 148 connecting a handle to the solid jaw 142. Movement of the handles 146 together translates to an axial movement of the piston 148, and thereby a relative movement of the solid and split jaws 142 and 144. It will be appreciated that although the exemplary installation tool 100 shown in the figures is configured such that the solid jaw 142 moves relative to the remainder of the tool 100 though action of the piston 148, an installation tool 100 may be configured such that the split jaw 144 moves while the solid jaw 142 is fixed, or both the solid and fixed jaws 142 and 144 move relative to the remainder of the installation tool 100.

With an appropriate interface nub 138 attached to the tool 100, a connector head 12 comprising an adaptor component 12*a*, an inner locking member 12*b* and a split ring 12*c* may be threaded onto the interface nub 138. A transition dielectric 28 may be inserted into the inner locking member 12*b* prior to threading the connector head 12 onto the interface nub 138. A transition conductor 26 may be inserted over the end of the cable's inner conductor 24 and, as shown in FIGS. 12A and 12B, the cable 18 may be placed in the split between the split jaws 44 and the end of the cable 18 may be inserted into the base of the connector head 12. During insertion, the tip of the transition conductor 26 may be aligned with an inner bore of the transition dielectric 28. As shown in FIGS. 12B and 12D, the external locking ring 16 may be captured by a recess in the split jaws 144.

When the components of the cable and connector are assembled as shown in FIG. 12B, the solid and split jaws 142 and 144 may be forced together as shown in FIGS. 12C and 12D. As a result of the forcing together, several components engage with and lock into one another, resulting in a fully assembled connector. For example, the ratchets 12*b*-4 of inner locking member 12*b* engage mating ratchets 16*b* of external locking ring 16. The transition conductor 26 is fully inserted into transition dielectric 28 and may be mechanically locked in place via interaction between a barb or knurling on the transition conductor 26 and the inner bore of the transition dielectric 28. Interference fit areas 16*a* and/or 16*c* may respectively engage interference fit area 14*a* of the internal clamping ring 14 and interference fit area 12*b*-5 of inner locking member 12*b*. Also, the shielding 20 may be sandwiched between the internal clamping ring 14 and the inner locking member 12 as described above.

At the end of a compression stroke of the handles 146, when a preconfigured level of compression of the connector components has been achieved, the installation tool 100 may be configured to release the compression force being exerted on the solid and split jaws 142 and 144. This release may be configured to occur before any compression of the handles 146 is released by the user. Accordingly, by releasing the compression force, the installation tool 100 may serve to prevent over compression of the connector components by the user and may also serve to signal to the user that sufficient compression force has been applied. Other signaling devices may be configured and employed, such as "clicks" or other audible indicators of the sufficiency or level of compression being applied to the connector components.

In order to address various issues and advance the art, the entirety of this application (including the Cover Page, Title, Headings, Background, Summary, Brief Description of the Drawings, Detailed Description, Claims, Abstract, Figures, and otherwise) shows, by way of illustration, various embodiments in which the claimed present subject matters may be practiced. The advantages and features of the application are of a representative sample of embodiments only, and are not exhaustive and/or exclusive. They are presented only to assist in understanding and teach the claimed principles. It should be understood that they are not representative of all claimed present subject matters. As such, certain aspects of the disclosure have not been discussed herein. That alternative embodiments may not have been presented for a specific portion of the present subject matter or that further undescribed alternate embodiments may be available for a portion is not to be considered a disclaimer of those alternate embodiments. It may be appreciated that many of those undescribed embodiments incorporate the same principles of the present subject matters and others are equivalent. Thus, it is to be understood that other embodiments may be utilized and functional, logical, operational, organizational, structural and/or topological modifications may be made without departing from the scope and/or spirit of the disclosure. As such, all examples and/or embodiments are deemed to be non-limiting throughout this disclosure. Also, no inference should be drawn regarding those embodiments discussed herein relative to those not discussed herein other than it is as such for purposes of reducing space and repetition. Also, some of these embodiments and features thereof may be mutually contradictory, in that they cannot be simultaneously present in a single embodiment. Similarly, some features are applicable to one aspect of the present subject matter, and inapplicable to others. In addition, the disclosure includes other present subject matters not presently claimed. Applicant reserves all rights in those presently unclaimed present subject matters including the right to claim such present subject matters, file additional applications, continuations, continuations in part, divisions, and/or the like thereof. As such, it should be understood that advantages, embodiments, examples, functional, features, logical, operational, organizational, structural, topological, and/or other aspects of the disclosure are not to be considered limitations on the disclosure as defined by the claims or limitations on equivalents to the claims. It is to be understood that, depending on the particular needs and/or characteristics of solderless coaxial cable connector user, various embodiments of the connector and installation thereof may be implemented that enable a great deal of flexibility and customization.

What is claimed is:

1. A cable connector comprising:

a first member including an inner surface and an exterior ratchet;

a second member including an internal passageway configured to receive a cable end and an external surface configured to sandwich a shielding of the cable between the external surface of the second member and the inner surface of the first member; and a third member including a ratchet configured to mechanically engage with the exterior ratchet of the first member, the third member being configured to hold the second member against the first member, thereby sandwiching the shielding of the cable between the first member and the second member.

2. The cable connector of claim 1, wherein a nose portion of the external surface of the second member, adjacent to the internal passageway, is configured at an angle of approximately 90 degrees from the internal passageway.

3. The cable connector of claim 1, wherein a nose portion of the external surface of the second member, adjacent to the internal passageway, is configured at an angle of greater than 90 degrees from the internal passageway.

4. The cable connector of claim 1, wherein the second member includes an inner shoulder at an end of the internal passageway, the inner shoulder having an opening that is smaller than the internal passageway.

5. The cable connector of claim 1, wherein:

the external surface of the second member includes a nose portion and a transition portion, with the nose portion between the transition portion and the internal passageway, and the nose portion is configured at a non-zero angle from the internal passageway and the transition portion is configured at a non-zero angle from the nose portion such that the transition portion is configured at an angle of greater than 90 degrees from the internal passageway.

6. The cable connector of claim 5, wherein the transition portion is configured at an angle of approximately 135 degrees from the internal passageway.

7. The cable connector of claim 5, wherein the external surface of the second member further includes an outer portion, with the transition portion between the outer portion and the nose portion, and the outer portion is configured at a non-zero angle from the transition portion and is configured approximately parallel to the internal passageway.

8. The cable connector of claim 5, wherein the inner surface of the first member includes a shoulder portion opposite the nose portion of the external surface of the second member and a transition portion opposite the transition portion of the external surface of the second member.

9. The cable connector of claim 7, wherein the inner surface of the first member includes a shoulder portion opposite the nose portion of the external surface of the second member, a transition portion opposite the transition portion of the external surface of the second member, and an outer portion opposite the outer portion of the external surface of the second member.

10. The cable connector of claim 1, wherein the second member and third member are joined by an interference fit between mating surfaces thereof.

11. The cable connector of claim 1, wherein the first member and the third member are joined by an interference fit between mating surfaces thereof in addition to the engagement between the external ratchet of the first member and the ratchet of the third member.

12. The cable connector of claim 1, wherein:

the second member and third member are joined by an interference fit between mating surfaces thereof and the first member and the third member are joined by an interference fit between mating surfaces thereof in addition to the engagement between the external ratchet of the first member and the ratchet of the third member.

13. The cable connector of claim 12, wherein the interference fit between the second member and the third member is configured to engage before the external ratchet of the first member engages with the ratchet of the third member as the first, second and third members are pressed together.

14. The cable connector of claim 12, wherein the interference fit between the first member and the third member is configured to engage after the external ratchet of the first member first engages with the ratchet of the third member as the first, second and third members are pressed together.

15. The cable connector of claim 1, wherein the external ratchet of the first member and the ratchet of the third member each include a plurality of discrete slopes.

16. The cable connector of claim 15, wherein number of discrete slopes included in the external ratchet of the first member is different than the number of discrete slopes included in the ratchet of the third member.

17. The cable connector of claim 1, wherein the mechanical engagement between the external ratchet of the first member and the ratchet of the third member emits an audible sound.

18. The cable connector of claim 15, wherein mechanical engagement between the plurality of discrete slopes of the external ratchet of the first member and the plurality of discrete slopes of the ratchet of the third member emits a plurality of audible sounds.

19. A cable connector comprising:

a first member including an inner surface and an exterior interference fit surface;

a second member including an internal passageway configured to receive a cable end and an external surface configured to sandwich a shielding of the cable between the external surface of the second member and the inner surface of the first member; and a third member including an interference fit surface configured to form an interference fit with the exterior interference fit surface of the first member, the third member being configured to hold the second member against the first member, thereby sandwiching the shielding of the cable between the first member and the second member.

20. The cable connector of claim 19, wherein the second member and third member are joined by an interference fit between mating surfaces thereof.

* * * * *